US006059286A

United States Patent [19]

Miyashita

[11] Patent Number: 6,059,286

[45] Date of Patent: May 9, 2000

[54] SHEET CONVEYOR AND APPARATUS EQUIPPED THEREWITH

[75] Inventor: Kenji Miyashita, Toyokawa, Japan

[73] Assignee: Minolta, Co., Ltd., Osaka, Japan

[21] Appl. No.: 09/019,474

[22] Filed: Feb. 5, 1998

[30] Foreign Application Priority Data

Feb. 6, 1997 [JP] Japan ..... 9-023847

[51] Int. Cl.[7] ..... B65H 5/06

[52] U.S. Cl. ..... 271/274; 271/273

[58] Field of Search ..... 271/273, 274, 271/902

[56] References Cited

U.S. PATENT DOCUMENTS

| | | | |
|---|---|---|---|
| 3,067,999 | 12/1962 | Skeen | 271/274 |
| 5,029,845 | 7/1991 | Simpson-Davis | 271/273 |
| 5,173,596 | 12/1992 | Kapinos et al. | 271/274 |
| 5,203,217 | 4/1993 | Buckley | 271/273 |
| 5,351,945 | 10/1994 | Asakawa et al. | 271/273 |

FOREIGN PATENT DOCUMENTS

| | | | |
|---|---|---|---|
| 0057452 | 3/1988 | Japan | 271/274 |
| 403243548A | 10/1991 | Japan | 271/273 |
| 08-026522 | 1/1996 | Japan . | |
| 8-26522 | 1/1996 | Japan . | |

*Primary Examiner*—H. Grant Skaggs
*Attorney, Agent, or Firm*—Sidley & Austin

[57] ABSTRACT

First bearing position 22 and second bearing position 23 are formed on bearing member 14 that supports rotational shaft 32 of driving conveyance roller 12 while being subjected to pressure from bearing spring 15. Normally, rotational shaft 32 is supported by first bearing position 22, and driving conveyance roller 12 is kept in pressure contact with the driven conveyance roller via the force from bearing spring 15. Conveyance of sheets is performed in this state. When the apparatus is stopped due to a paper jam and the user pulls out the jammed sheet, the force of the pulling causes rotational shaft 32 to detach from first bearing position 22 and move to second bearing position 23 and driving conveyance roller 12 loses pressure contact with the driven conveyance roller. Therefore, the sheet may be easily pulled out, and the apparatus may be reset for continued use.

16 Claims, 5 Drawing Sheets

SHEET CONVEYOR AND APPARATUS EQUIPPED THEREWITH

This application is based on application No. Hei 9-23847 filed in Japan, the content of which is hereby incorporated by reference.

FIELD OF THE INVENTION

The present invention pertains to apparatuses equipped with a device to convey sheet-like objects, such as copying machines and printers.

The present invention also pertains to a conveyor of sheets that are used in such apparatuses, such as sheets of printing paper or original document sheets, and more particularly, to a sheet conveyor in which, when a sheet jam occurs, the sheet jammed in the conveyor (hereinafter 'a jammed sheet') may be easily removed, as well as to apparatuses equipped with the sheet conveyor.

BACKGROUND OF THE INVENTION

Copying machines and printers are equipped with a sheet conveyor that individually conveys sheets of a prescribed configuration that are stacked on a tray or cassette so that images of characters, graphs or figures may be recorded on a recording medium having a sheet-like configuration, such as a sheet of printing paper. In a conventional sheet conveyor, the top sheet of the stack of sheets is fed out by means of a paper feed roller, and the sheet thus fed out is sandwiched between a driven conveyance roller which is coaxially situated with respect to the paper feed roller and a driving conveyance roller that is in contact with the driven conveyance roller and that is driven to rotate by means of a motor, such that the sheet is conveyed. In order to ensure conveying force, the driving conveyance roller is pressed onto the driven conveyance roller by means of a spring.

However, the problem described below has been pointed out in connection with conventional sheet conveyors like the one explained above. The sheets being conveyed sometimes cause jamming in a sheet conveyor of this type. Since the sheet conveyor temporarily stops in such a case, it must be restarted after removing the jammed sheets including the sheet that caused the jam. Where a jam occurs while a sheet is being sandwiched between the driven conveyance roller and the driving conveyance roller, the user can see the jammed sheet if he removes the tray or cassette on which sheets are stacked. The user then tends to pull out the jammed sheet toward him by hand (in the direction opposite from the normal conveyance of sheets)

However, since the jammed sheet is being sandwiched between the driven conveyance roller and driving conveyance roller that are in spring-driven pressure contact with each other, the sheet does not slip out easily from between the driven conveyance roller and driving conveyance roller. In addition, since the driving conveyance roller is connected to a motor, it is difficult to rotate it in the reverse direction by pulling the sheet (forcing the roller to rotate in the direction opposite from its normal direction of rotation). Therefore, it is almost impossible for the user to remove the sheet by pulling it out. If he forcibly pulls it out, the sheet becomes torn and a part of it remains in the conveyor, which creates an even more difficult situation. Alternatively, if the user were to attempt to forcibly remove a sheet that had a very high friction coefficient and was difficult to tear, damage could be caused to the gears of the drive system for the driving conveyance roller. Since this would lead to a malfunction in the sheet conveyor, the conveyor would need to be disassembled and repaired before it was restarted. Such a situation can generally occur not only in copying machines or printers, but also in any machine in which a sheet-like object is conveyed while it is being sandwiched.

SUMMARY OF THE INVENTION

The present invention was made in order to resolve the problem with conventional sheet conveyors explained above. Its object is to provide a sheet conveyor capable of clearing a paper jam without causing additional problems, as well as to provide apparatuses equipped with the device.

Another object of the present invention is to provide a sheet conveyor from which the user can easily remove the jammed sheet by pulling it out in the case of a paper jam and which can be restored to a state from which it can be restarted, as well as to provide apparatuses equipped with the device.

In order to attain these objects, one aspect of the present invention is a sheet conveyor comprising a first roller that can rotate around a shaft, a second roller that sandwiches the sheet between itself and the first roller and that can rotate around a shaft, a pressure member that applies pressure onto the second roller such that it is pressed onto the first roller, and a bearing member that receives the pressure from the pressure member and that supports the rotational shaft of roller. The second roller. The sheet conveyor conveying sheets in a prescribed direction by virtue of the rotation of the first roller and second roller, wherein the bearing member has a first position that presses the rotational shaft of the second roller toward the first roller by virtue of the pressure from the pressure member and a second position that receives from the rotational shaft of the second roller force that works in the direction opposite from the pressure from the pressure member, such that when an external force that works in the direction opposite from the direction of sheet conveyance is applied to the second roller, the rotational shaft of the second roller moves out of the first position and into the second position.

In this sheet conveyor, the second roller is pressed onto the first roller by means of the pressure from the pressure member via the bearing member. In a normal situation, the rotational shaft of the second roller is supported in the first position of the bearing member and is in pressure contact with the first roller. The sheet that enters between the first roller and second roller is conveyed in a prescribed direction of conveyance due to the rotation of these rollers while being sandwiched between them. Where a paper jam occurs and the conveyance stops with a sheet stuck between the first roller and second roller, if the jammed sheet is pulled, an external force that works in the direction opposite from the direction of sheet conveyance is applied to the second roller. When this external force is applied, the rotational shaft of the second roller moves out of the first position of the bearing member and into the second position. In this state, the rotational shaft of the second roller is pressing the bearing member in the direction opposite from the direction of the pressure from the pressure member. Therefore, the second roller and first roller are no longer in pressure contact with each other, such that the jammed sheet may be easily pulled out by hand. In addition, the manual pulling of the sheet does not place any load on the first roller or the drive system for the second roller.

Further, in the sheet conveyor, when the external force is no longer being applied, the rotational shaft of the second roller moves from the second position to the first position due to the pressure from the pressure member such that the second roller comes to be in pressure contact with the first roller.

In this sheet conveyor, when the external force that is applied in the direction opposite from the direction of sheet conveyance and that is being applied to the second roller is removed, as when a jammed sheet has been pulled out, the rotational shaft of the second roller moves from the second position to the first position of the bearing member due to the pressure from the pressure member. This is a state where the second roller is in pressure contact with the first roller due to the pressure from the pressure member and is equivalent to the state in which no paper jam exists. Therefore, if the jammed sheet is pulled out, the conveyance of sheets becomes possible again.

As described above, using the construction described above, the jammed sheet may be easily pulled out, with no further problems arising as a result.

Further, using the construction described above, the user can remove the jammed sheet by pulling it out by hand during a paper jam without the sheet getting torn, nor is damage caused to the device during said pulling. This easily restores the device to a state in which it may be used again after the paper jam.

These and other objects, advantages and features of the invention will become apparent from the following description thereof taken in conjunction with the accompanying drawings, which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENT

Figure 1:
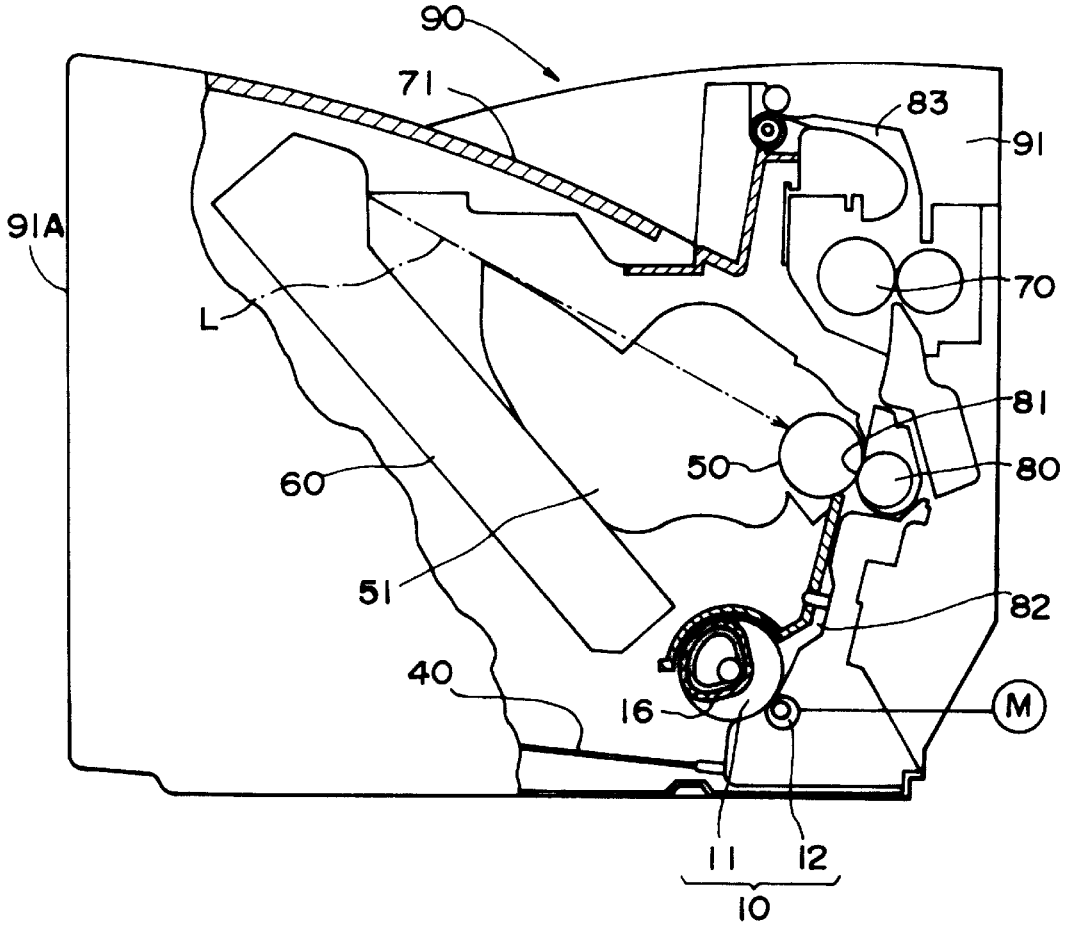
FIG. 1 is a cross-sectional view of the entire printer.

The present invention is explained in detail below with reference to the drawings in connection with a printer and a specific embodiment which is used for the paper feeder component of the printer. Printer 90 pertaining to this embodiment comprises, as shown in the basic construction drawing of FIG. 1, image forming unit 51 constructed around photoreceptor drum 50, laser device 60 that irradiates laser beam L onto photoreceptor drum 50 in response to print data, sheet conveyor 10 that supplies sheets, paper feed tray 40 that houses in a stack sheets that are used for the printing, and fusing device 70 that stabilizes the toner image on the sheet, all of which components are mounted inside outer frame 91.

Image forming unit 51 forms a toner image on the outer circumference of photoreceptor drum 50. For this purpose, it is equipped with a public domain charger, developing device, etc. Transfer roller 80 which transfers the toner image to the sheet is also mounted next to photoreceptor drum 50. Sheet conveyor 10 conveys sheets fed out of paper tray 40 individually toward area 81 at which photoreceptor drum 50 and transfer roller 80 face each other, and has driven conveyance roller 11, driving conveyance roller 12, etc. Its details are explained below. Paper feed path 82 through which sheets pass is formed between sheet conveyor 10 and area 81. Fusing device 70 that thermally bonds the toner image to the sheet and eject paper tray 71 on which are stacked sheets that have passed through this fusing device 70 are mounted above photoreceptor drum 50. Eject paper path 83 is formed between fusing device 70 and eject paper tray 71. Panel 91A of the outer frame shown on the left in FIG. 1 may be opened and closed. When it is open, sheets may be supplied to or removed from paper feed tray 40, and paper feed tray 40 side of sheet conveyor 10 may be observed from the outside.

In printer 90 having the construction described above, when a print operation is begun, laser beam L is irradiated from laser device 60 based on print data, by which an electrostatic latent image is formed on the outer circumference of photoreceptor drum 50. This electrostatic latent image is developed by image forming unit 51 and becomes a toner image. On the other hand, one of the sheets that are fed individually from paper feed tray 40 by means of sheet conveyor 10 reaches area 81 via paper feed path 82, whereupon the toner image is transferred to the sheet. The sheet onto which the toner image is transferred undergoes stabilization of the toner image when passing through fusing device 70, and is ejected onto eject paper tray 71 via eject paper path 83.

Figure 2:
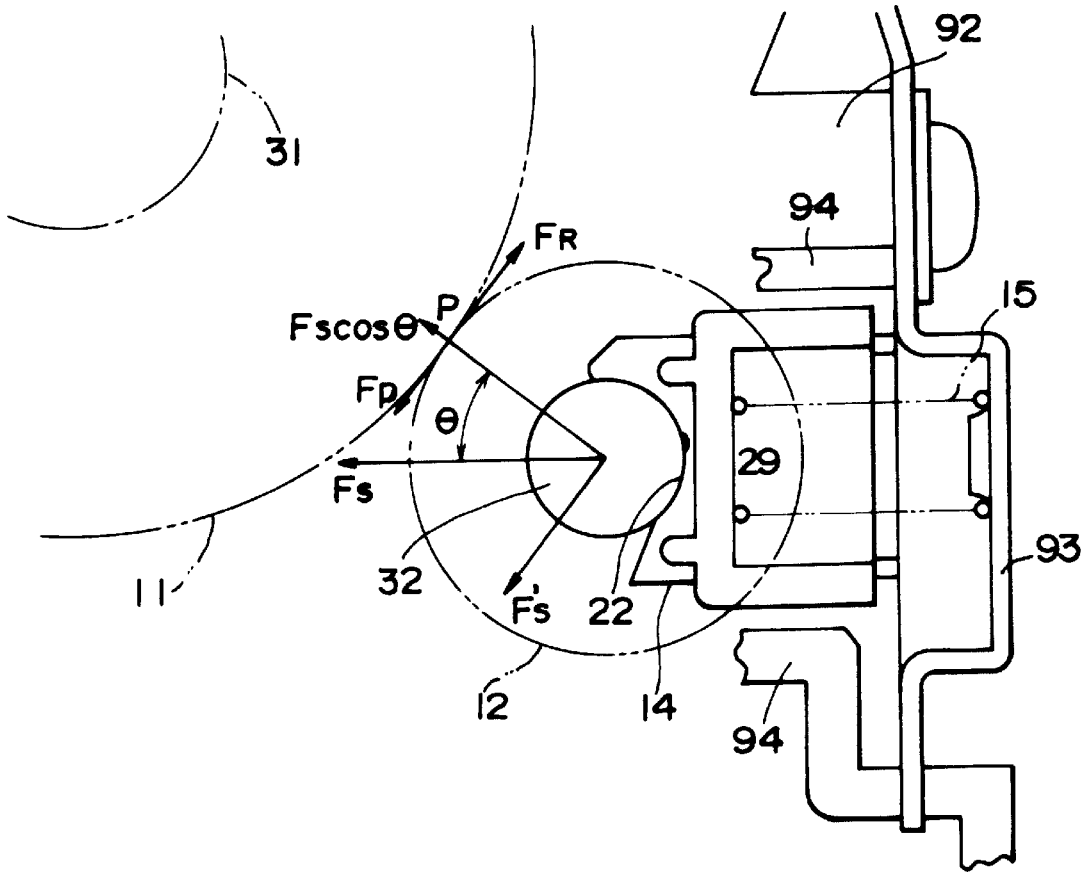
FIG. 2 is a cross-sectional view of a sheet conveyor of the printer shown in FIG. 1.

Among the components of printer 90 described above, sheet conveyor 10, which is the equivalent to the sheet conveyor of the present invention, will now be explained with reference to FIG. 2. Sheet conveyor 10 mainly comprises driven conveyance roller 11 (first roller) and driving conveyance roller 12 (second roller) as described above. Both rollers can rotate about the longitudinal axes of their shafts. However, while driven conveyance roller 11 can rotate relative to its rotational shaft 31, driving conveyance roller 12 rotates together with its rotational shaft 32 as if they were one unit. In addition, while the position of rotational shaft 31 of driven conveyance roller 11 is fixed relative to frame 92, the position of rotational shaft 32 of driving conveyance roller 12 may be changed to some extent by means of a public domain joint mechanism. As shown in FIG. 1, paper feed roller 16 is mounted such that it is coaxially situated with respect to driven conveyance roller 11. Although not shown in FIG. 2, paper feed roller 16 is mounted to rotational shaft 31 via a public domain spring clutch, and can rotate in one direction only.

Mounting stay 93 is attached to frame 92 using a screw. Bearing member 14 and bearing spring 15 are sandwiched between rotational shaft 32 and mounting stay 93. Bearing spring 15 is sandwiched between spring receiver 29 behind bearing member 14 and mounting stay 93 while being compressed. Cylindrical bearing sleeve 94 is formed on frame 92 such that bearing member 14 is positioned in the bearing sleeve 94 and may move laterally in FIG. 2. Due to this construction, force is applied to rotational shaft 32 via bearing member 14 due 20 to spring force FS of bearing spring 15, such that rotational shaft 32 is pushed toward driven conveyance roller 11. This consequently presses driving conveyance roller 12 onto driven conveyance roller 11. Here, the line that connects rotational shaft 31 and rotational shaft 32 is angled at approximately 40 relative to the direction of the pressure from bearing spring 15 (crossed-axis angle θ). Rotational shaft 32 is connected to motor M such that it is driven by the motor M (see FIG. 1).

Figure 3:
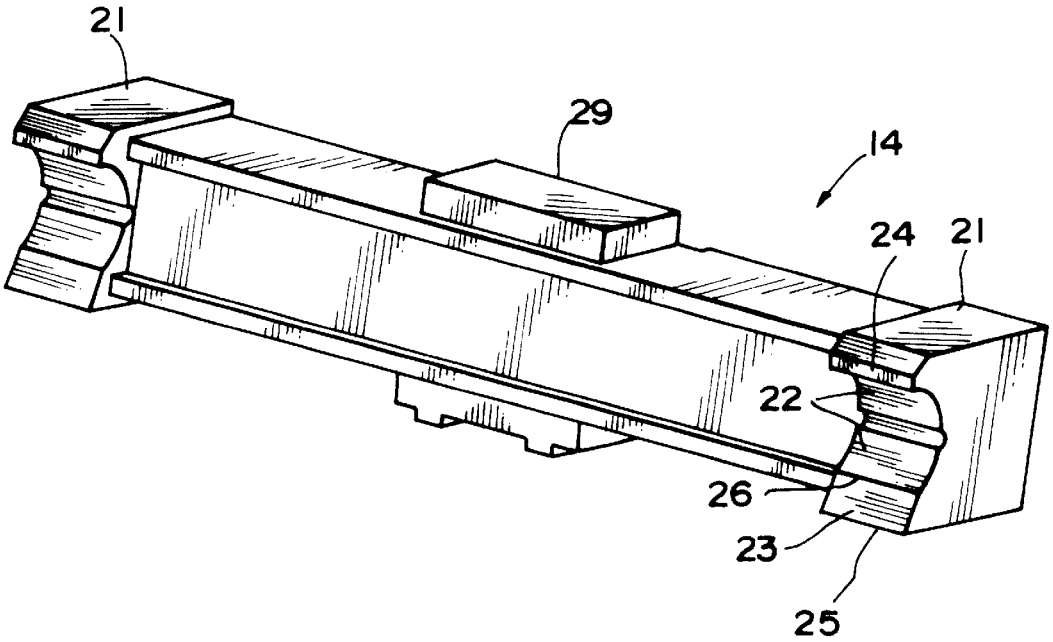
FIG. 3 is a perspective view of a bearing member of the present invention.
Figure 4:
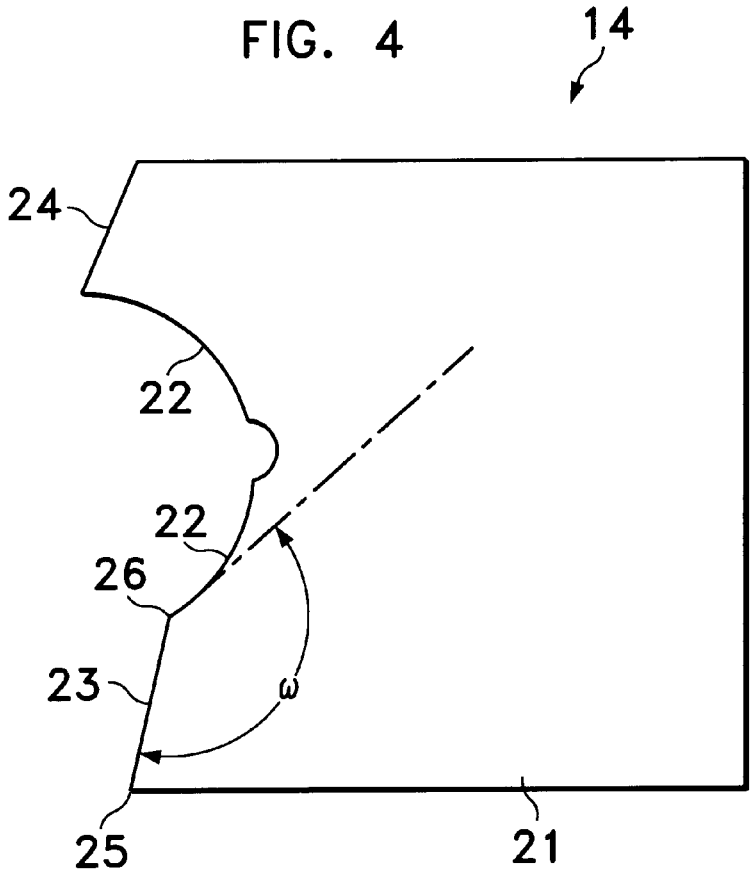
FIG. 4 is a side view of a bearing part of the bearing member shown in FIG. 3.

Bearing member 14 is a long member as shown in the perspective view of FIG. 3, and has bearing parts 21 on either end. It also has spring receiver 29 in the center area on its back side. The side surface of bearing part 21 has an essentially rectangular shape, as shown in FIG. 4, and first bearing position 22 is formed on one edge. This first bearing position 22 has an arc configuration that matches the outer circumference of rotational shaft 32. The ends of the arc are different in height: The top end is a higher first end 24 and the lower end is a lower second end 25. Between first bearing position 22 and second end 25 is formed second bearing position 23 which is distinguished from first bearing position 22 by ridge line 26. Crossed-axis angle ω between first bearing position 22 and second bearing position 23 at ridge line 26 is an obtuse angle of approximately 170°.

Because bearing member 14 has the configuration described above, in the state shown in FIG. 2, bearing spring 15 presses against bearing member 14 with its spring force FS exerted toward the left in the drawing. Due to this pressure, driving conveyance roller 12 is put into pressure contact with driven conveyance roller 11, and rotational shaft 32 of driving conveyance roller 12 is kept engaged with first bearing position 22 of bearing member 14. There are two pairs of driving conveyance roller 12 and driven conveyance roller 11, and each pair is mounted outside each bearing part 21 of bearing member 14. The pressure with which driving conveyance roller 12 is pressed against driven conveyance roller 11 is expressed as FS cos e, using force FS and crossed-axis angle θ. Sheets are conveyed by driving motor M which rotates rotational shaft 32 clockwise in the drawing with the rollers in this state. When sheets are conveyed, conveying force FR works at the contact point P of driving conveyance roller 12 and driven conveyance roller 11 in the direction of the tangent. In order to oppose this force, a spring is selected for bearing spring 15 whose component force F'S (=FS sin θ) of spring force FS which is parallel to conveying force FR is larger than conveying force FR. Conveying force FR maintains a force of 5 kgf or more so that large sheets, such as A4 size sheets, may be conveyed.

Figure 5:
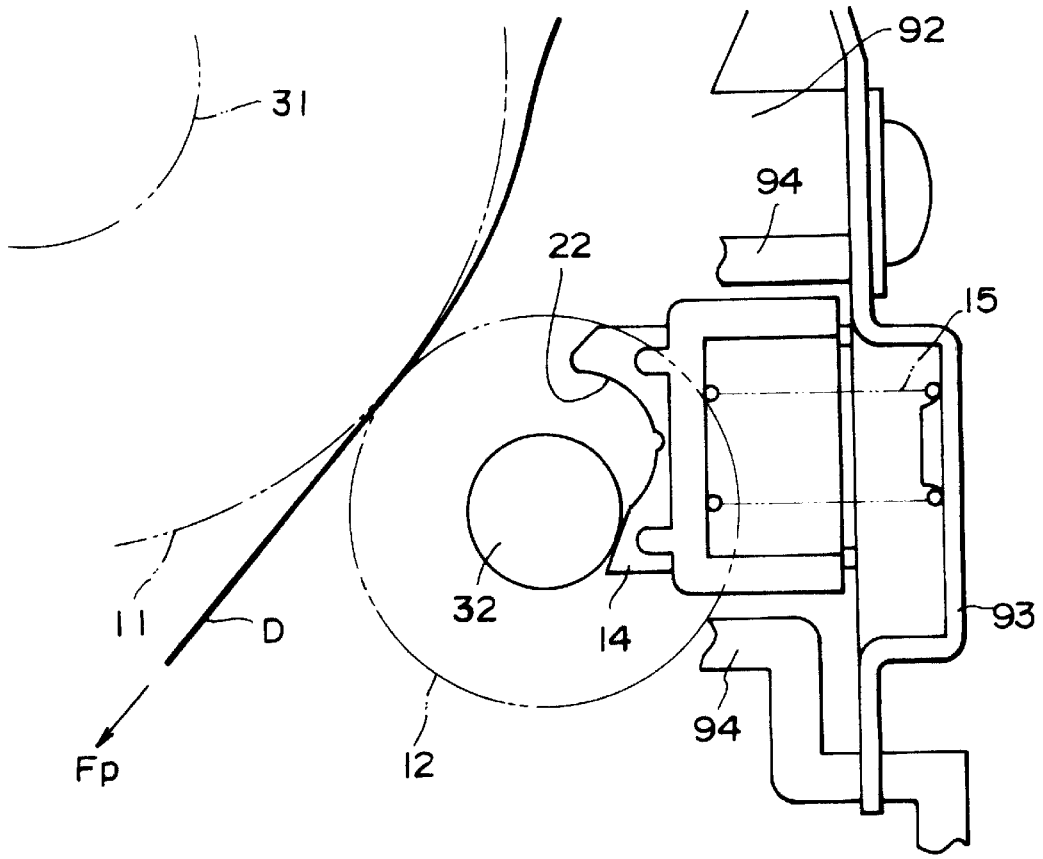
FIG. 5 is a cross-sectional view of the sheet conveyor of the present invention while a sheet is being pulled out.

On the other hand, where an external force that works in the direction opposite from direction of conveyance is applied to contact point P, rotational shaft 32 can easily become detached from first bearing position 22 because ridge line 26 of bearing part 21 creates an obtuse angle. External force Fp required for this to happen is expressed as F'S sin ω, using component force F'S and crossed-axis angle ω. The amount of external force Fp required is small because crossed-axis angle ω is an obtuse angle close to 180° and is 2 kgf or smaller. When rotational shaft 32 is detached from first bearing position 22, rotational shaft 32 is in contact with second bearing position 23 of bearing part 21, as shown in FIG. 5. In this state, rotational shaft 32 presses bearing member 14 against bearing spring 15 due to external force Fp. Therefore, bearing spring 15 is slightly more compressed than in the state shown in FIG. 2 and driving conveyance roller 12 is not pressed against driven conveyance roller 11.

The operation of sheet conveyor 10 having the construction described above will now be explained. When motor M is driven to rotate rotational shaft 32 clockwise in the drawing when the device is in the state shown in FIG. 2, driving conveyance roller 12 rotates together with rotational shaft 32. When this happens, because component force F'S of spring force FS is larger than conveying force FR, as described above, and because rotational shaft 32 is prevented from changing positions due to first end 24 of bearing part 21, rotational shaft 32 does not detach from first bearing position 22 and driving conveyance roller 12 and driven conveyance roller 11 are therefore kept in pressure contact. As a result, when driving conveyance roller 12 rotates, driven conveyance roller 11 rotates as well. Therefore, the sheet that has entered between driving conveyance roller 12 and driven conveyance roller 11 is conveyed in the direction of conveyance while being sandwiched by the rollers 12 and 11.

Let us now suppose that a paper jam occurs in printer 90, and that sheet conveyance stops while a sheet is sandwiched between driving conveyance roller 12 and driven conveyance roller 11. When this occurs, if panel 91A of printer 90 is opened, the user can see sheet conveyor 10 from the left-hand side of FIG. 1, as well as the jammed sheet between driving conveyance roller 12 and driven conveyance roller 11. The user will try to remove the jammed sheet that he sees by pulling it out by hand to clear the paper jam and restore printer 90 to an operational state.

Thus, if the user pulls the jammed sheet toward himself, since the direction of the pulling is opposite from the direction of sheet conveyance, the pulling works as an external countervailing force relative to the point where the sheet is sandwiched, i.e., contact point P of driving conveyance roller 12 and driven conveyance roller 11. Because this manual pulling force easily reaches approximately 2 kgf and exceeds Fp even if the user is not particularly strong, rotational shaft 32 of driving conveyance roller 12 detaches from first bearing position 22 and sheet conveyor 10 enters the state shown in FIG. 5. In this state, driving conveyance roller 12 and driven conveyance roller 11 are no longer in pressure contact as described above, and therefore, jammed sheet D is pulled out in the direction opposite from direction of conveyance without being torn if the user continues to pull it. When this happens, because driving conveyance roller 12 is not caused to rotate by sheet D being pulled but remains stationary, no load is applied to the transmission system that transmits the driving force of motor M. As sheet D is pulled, driven conveyance roller 11 rotates in the direction opposite from the direction of rotation when conveying a sheet.

When the leading edge of sheet D leaves the area between driving conveyance roller 12 and driven conveyance roller 11, the external force that operates in a direction opposite from direction of conveyance is no longer present. Therefore, sheet conveyor 10 returns to the state shown in FIG. 2 due to spring force FS of bearing spring 15. The user can easily remove the jammed sheet in this way. Needless to say, printer 90 may be restarted in this state.

As explained in detail above, printer 90 of this embodiment uses sheet conveyor 10 in which rotational shaft 32 of driving conveyance roller 12 is supported by bearing member 14 and driving conveyance roller 12 is pressed against driven conveyance roller 11 by means of bearing spring 15 via this bearing member 14. Consequently, while normally a sheet may be reliably conveyed in the direction of conveyance with driving conveyance roller 12 kept in pressure contact with driven conveyance roller 11, when the user pulls a jammed sheet in the direction opposite from direction of conveyance after a paper jam occurs, rotational shaft 32 comes out of first bearing position 22 of bearing member 14, whereupon driving conveyance roller 12 loses pressure contact with driven conveyance roller 11 and the user may easily remove the jammed sheet by pulling it out. In doing so, the sheet does not become torn, nor is damage caused to the drive system for driving conveyance roller 12. In addition, after the pulling, sheet conveyor 10 automatically returns to the normal state by virtue of the spring force of bearing spring 15 such that the printer may be used again. The present embodiment thus provides a superior printer 90 that is easy to use.

Further, in sheet conveyor 10 of this embodiment, where an excessive conveying force is applied to driving conveyance roller 12, as when two or more sheets are fed together, rotational shaft 32 detaches from first bearing position 22 whereupon driving conveyance roller 12 ceases to have pressure contact with driven conveyance roller 11, as in the case described above, the present embodiment also has the effect of working as a torque limiter with regard to excessive load and of preventing damage from occurring to the drive system, etc.

The present invention is not limited to the embodiment described above. Needless to say, various improvements and modifications may be made within its scope. For example, the specific values such as angles θ and ω used in the description of the embodiment are only examples. The present invention can also be applied not only in printers but also in copying machines and facsimile machines. It can be applied in all types of mechanisms that carry a sheet-like object by sandwiching it by means of two rollers which are in pressure contact with each other. For example, the present invention may be applied to a mechanism in an automatic document feeder (ADF) that individually feeds original document sheets that are stacked on an original document tray such that they are sent toward the platen glass individually.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An apparatus having a sheet conveying device comprising:

a first roller which is rotatably supported;

a second roller which is rotatably supported to catch a sheet between said first roller and said second roller for conveying the sheet in a predetermined direction;

an urging member which urges said second roller toward said first roller to press said second roller to said first roller; and a bearing member which supports a rotational shaft of said second roller and receives the urging force caused by said urging member, wherein said bearing member comprises:

a first portion which receives said rotational shaft of said second roller for allowing said second roller to be pressed to said first roller; and a second portion which receives said rotational shaft of said second roller in place of said first portion for releasing pressure between the first and the second roller when a force toward a direction opposite to the predetermined direction is applied to said second roller.

2. An apparatus as claimed in claim 1, wherein said rotational shaft of said second roller returns to said first portion by means of the urging force of said urging member when said force is removed.

3. An apparatus as claimed in claim 1, wherein said apparatus is an image forming apparatus.

4. An apparatus as claimed in claim 3, wherein said image forming apparatus is a printer.

5. An apparatus as claimed in claim 4, wherein said sheet is a paper for printing an image thereon.

6. A sheet conveying device comprising:

a first roller which is rotatably supported;

a second roller which is rotatably supported to catch a sheet between said first roller and said second roller for conveying the sheet in a predetermined direction;

an urging member which urges said second roller toward said first roller to press said second roller to said first roller; and a bearing member which supports a rotational shaft of said second roller and receives the urging force caused by said urging member, wherein said bearing member comprises:

a first portion which receives said rotational shaft of said second roller for allowing said second roller to be pressed to said first roller; and a second portion which receives said rotational shaft of said second roller in place of said first portion for releasing pressure between the first and the second roller when a force toward a direction opposite to the predetermined direction is applied to said second roller.

7. A device as claimed in claim 6, wherein said rotational shaft of said second roller returns to said first portion by means of the urging force of said urging member when said force is removed.

8. An apparatus as claimed in claim 6, wherein said sheet is a paper for printing an image thereon.

9. An apparatus having a sheet conveying device comprising:

a first roller and a second roller for holding a sheet therebetween to convey the sheet in a predetermined direction; and a bearing member which supports said second roller, wherein said bearing member comprises:

a first portion which receives said second roller for allowing said rollers to hold the sheet therebetween; and a second portion which receives said second roller in place of said first portion for releasing the sheet when a force toward a direction opposite to the predetermined direction is applied to said second roller.

10. An apparatus as claimed in claim 9, wherein said second roller returns to said first portion when said force is removed.

11. An apparatus as claimed in claim 9, wherein said apparatus is an image forming apparatus.

12. An apparatus as claimed in claim 11, wherein said image forming apparatus is a printer.

13. An apparatus as claimed in claim 12, wherein said sheet is a paper for printing an image thereon.

14. A sheet conveying device comprising:

a first roller and a second roller for holding a sheet therebetween to convey the sheet in a predetermined direction; and a bearing member which supports said second roller, wherein said bearing member comprises:

a first portion which receives said second roller for allowing said rollers to hold the sheet therebetween; and a second portion which receives said second roller in place of said first portion for releasing the sheet when a force toward a direction opposite to the predetermined direction is applied to said second roller.

15. A device as claimed in claim 14, wherein said second roller returns to said first portion when said force is removed.

16. An apparatus as claimed in claim 14, wherein said sheet is a paper for printing an image thereon.

* * * * *